United States Patent [19]

Goldblatt et al.

[11] Patent Number: 4,707,284

[45] Date of Patent: Nov. 17, 1987

[54] LUBE OIL ANTI-WEAR AGENT

[75] Inventors: Irwin L. Goldblatt, Edison; Harold Shaub, Berkeley Heights, both of N.J.

[73] Assignee: Exxon Research and Engineering Company, Florham Park, N.J.

[21] Appl. No.: 811,999

[22] Filed: Dec. 23, 1985

[51] Int. Cl.[4] ..... C10M 129/00

[52] U.S. Cl. ..... 252/32.7 E; 252/62 R; 252/56 R

[58] Field of Search ..... 252/32.7 E, 52 R, 56 R

[56] References Cited

U.S. PATENT DOCUMENTS

| | | | |
|---|---|---|---|
| 2,340,331 | 2/1944 | Knutson et al. | 252/53 |
| 2,387,999 | 10/1945 | Knutson et al. | 252/54.6 |
| 2,739,127 | 3/1956 | Morway et al. | 252/41 |
| 2,758,975 | 8/1956 | Cottle et al. | 252/49.8 |
| 2,871,191 | 1/1959 | Schott | 252/40.5 |
| 3,627,810 | 12/1971 | Chang et al. | 260/463 |
| 3,642,858 | 2/1972 | Frevel et al. | 260/463 |
| 4,217,298 | 8/1980 | Shikata et al. | 260/463 |
| 4,376,711 | 3/1983 | Shaub | 252/32.7 E |
| 4,419,251 | 12/1983 | Shim et al. | 252/32.7 F |
| 4,486,324 | 12/1984 | Kovcsec | 252/32.7 E |
| 4,495,075 | 1/1985 | Buckley | 252/32.7 F |
| 4,502,970 | 3/1985 | Schetelich et al. | 252/32.7 F |

FOREIGN PATENT DOCUMENTS

| | | |
|---|---|---|
| 89709 | 9/1983 | European Pat. Off. . |
| 1385002 | 7/1972 | United Kingdom . |

*Primary Examiner*—William R. Dixon, Jr.
*Assistant Examiner*—Cynthia A. Prezlock
*Attorney, Agent, or Firm*—Edward H. Mazer; John W. Ditsler

[57] ABSTRACT

A lube oil and method of making same having improved anti-wear properties is described. The lube oil comprises:

A. a basestock;

B. a diphenyl carbonate; and

C. a metal dialkyldithiophosphate salt.

4 Claims, No Drawings

LUBE OIL ANTI-WEAR AGENT

BACKGROUND OF THE INVENTION

The present invention is directed at a lube oil having satisfactory anti-wear and friction reducing properties while having a reduced phosphorus content. More specifically, the present invention is directed at a lube oil comprising a basestock, a metal dialkyldithiophosphate, and an aryl carbonate ester.

Typically, in present-day lube oil formulations for internal combustion engines, phosphorus-containing compounds, such as zinc dialkyldithiophosphate (ZDDP), are added to the lube oil formulation to provide improved anti-wear properties. However, it has been found that phosphorus from phophorus-containing compounds becomes deposited on the catalyst in catalytic converters, thereby decreasing the efficiency of catalytic converters over time. At the present time automotive lube oils typically contain a maximum of about 0.10 to about 0.14 wt.% phosphorus. To reduce the rate at which catalytic converters become fouled by phosphorus, it has been suggested that the maximum phosphorus content of lube oils be reduced to a range of about 0.05 to about 0.08 wt.%.

The use of carbonates in lube oils is known. U.S. Pat. Nos. 2,340,331 and 2,387,999 disclose the use of diethyl, diamyl, dilauryl, diphenyl, dicresyl, di-o-cresyl, dibenzyl, mono-ethyl, and monophenyl carbonates in lube oils to increase the extreme pressure characteristics and reduce the rate of wear of lubricating oils.

European Patent Publication No. 89,709 discloses the use of organic carbonic esters of higher alcohols in lubricants for internal combustion engines. Wear and Coefficient of Friction test data are reported.

It is desirable to decrease the concentration of phosphate-containing compounds, such as zinc dialkyldithiophosphate, present in lubricating oil to thereby decrease the rate at which phosphates become deposited on the catalyst.

It also is desirable to provide lube oils having anti-wear properties comparable to presently available lube oils, while also having a reduced phosphorus content.

It also is desirable to provide a lube oil having Coefficients of Friction comparable to presently available lube oils, while having a reduced phosphorus content.

The present invention is directed at a lube oil and method of manufacturing same wherein the lube oil comprises:

A. a basestock;
B. diphenyl carbonate; and,
C. a metal phosphate salt.

SUMMARY OF THE INVENTION

The present invention is directed at a lube oil having improved anti-wear properties comprising:

A. a basestock;
B. diphenyl carbonate; and
C. a metal salt of dialkyldithiophosphate.

The concentration of the metal dithiophosphate (MDDP) preferably is limited to a range of about 0.5 to about 1.0 wt.% of the lube oil so that the concentration of phosphorus is less than about 0.08 wt.%, preferably 0.06 wt.% or less, of the lube oil.

The present invention also is directed at a method for improving the anti-wear properties of a lube oil basestock comprising the addition to the basestock of an effective amount of:

A. diphenyl carbonate; and
B. metal dialkyldithiophosphate salt.

In a preferred embodiment the metal dialkyldithiophosphate salt comprises a Group IIB metal or a metal selected from the group consisting of copper, molybdenum, antimony, and mixtures thereof, with zinc being particularly preferred. The alkyl groups preferably comprise $C_3$ to $C_{10}$ alkyls. The concentration of the diphenyl carbonate relative to the base-stock ranges between about 0.1 and about 1.5 wt.%, preferably between about 0.5 and about 1.2 wt.%. The concentration of the metal dialkyldithiophosphate salt may range between about 0.5 and about 2.0 wt.%, preferably between about 0.5 and about 1.0 wt.%.

DETAILED DESCRIPTION OF THE INVENTION

The present invention is directed at a lube oil composition and method of making same where the lubricant has a reduced phosphorus content yet exhibits satisfactory anti-wear and friction reducing properties.

The present invention is directed at the combination of diphenyl carbonate with a metal dialkyldithiophosphate in a lube oil basestock.

Several carbonate esters first were tested at the 1.0 wt.% level in a lube oil. Marcol 72, a white oil having a viscosity of 17.7 mPa.s at 25° C. to determine their effectiveness at reducing initial seizure load and wear scar diameter (WSD). Initial seizure load is the load at which there is a rapid increase in wear as measured by WSD from the relatively low wear at relatively low loads. The initial seizure load was measured using a Four Ball Wear Test. The Four Ball Wear Test utilized was a slightly modified version of the test described by R. Benzing, et al., in *Friction and Wear Devices, Second Edition, American Society of Lubricating Engineers* (1976) page 21, the disclosure of which is incorporated herein by reference. In this Four Ball Test, three balls are fixed in a ball holder which is flooded with oil and a fourth ball, which is fixed in a rotating chuck, slides over the three stationary balls. The test was conducted at 1,200 rpm utilizing 52100 steel balls for a test duration of 5 minutes at 25° C. The wear scar diameters are reported for tests run under a 15 kg load. The tests were performed using both dry and wet air blanketing with the oil containing 1.0 wt.% ester. Both dry and wet air atmospheres were used in order to insure that the beneficial effects of the additive were observed over a broad range of field operating conditions. In addition, atmospheric control was used in order to improve test reproducibility. The results of these tests are summarized in Table 1.

TABLE 1

| Additive | Concentration (Wt. %) | Initial Seizure Load (kg) | | Wear Scar Diameter (mm) | |
|---|---|---|---|---|---|
| | | Dry Air | Wet Air | Dry Air | Wet Air |
| None | — | 55 | 30 | 0.37 | 0.40 |
| Dimethyl Carbonate | 1.0 | 60 | 55 | 0.33 | 0.38 |

TABLE 1-continued

| Additive | Concentration (Wt. %) | Initial Seizure Load (kg) | | Wear Scar Diameter (mm) | |
|---|---|---|---|---|---|
| | | Dry Air | Wet Air | Dry Air | Wet Air |
| Di-n-butyl Carbonate | 1.0 | 60 | 45 | 0.38 | — |
| Diethyl Carbonate | 1.0 | 55 | 50 | 0.37 | 0.38 |
| Di-n-hexyl Carbonate | 1.0 | 55 | 55 | 0.37 | 0.40 |
| Diphenyl Carbonate | 1.0 | 55 | 60 | 0.28 | 0.28 |
| Di-o-tolyl Carbonate | 1.0 | 60 | 55 | 0.28 | 0.30 |
| Di-p-tolyl Carbonate | 1.0 | 55 | 55 | 0.30 | 0.37 |
| Diethylene (cyclic) Carbonate | 1.0 | 55 | 55 | 0.30 | 0.33 |
| Tricresylphosphate | 1.0 | 50 | 50 | 0.30 | 0.35 |
| Zinc Dialkyldithiophosphate | 1.0 | 70 | 65 | 0.30 | 0.33 |

From this table it can be seen that the addition of carbonate esters to the white oil provided generally increased initial seizure load, particularly in the presence of wet air, and generally decreased wear.

Additional tests were run using several of the same carbonate ester additives in a formulated railroad lube oil. Four Ball Wear Tests were conducted using a 20 kg load at 177° C. for 30 minutes at 600 rpm utilizing a 52100 steel top ball fixed in the rotating chuck and three silver discs in place of the three stationary balls. The ball was initially loaded to 60 kg against the silver discs and rotated once prior to reducing the load to 20 kg. Table 2, below, summarizes the wear scar diameters and relative wear volumes.

TABLE 2

| Additive | Concentration (Wt. %) | Wear Scar Diameter (mm) | Relative Wear Volume |
|---|---|---|---|
| None | — | 2.3 | 1.0 |
| Ethylene Carbonate + Diphenyl Carbonate | 2.0 | 1.43 | 0.12 |
| Ethylene Carbonate | 1.0 | 1.19 | 0.04 |
| Diphenyl Carbonate | 1.0 | 1.50 | 0.15 |
| Di-o-tolyl Carbonate | 1.0 | 2.57 | 1.59 |
| Di-o-tolyl Carbonate | 5.0 | 1.97 | 0.52 |
| Dibutyl Carbonate | 1.0 | 1.62 | 0.22 |
| Di-n-hexyl Carbonate | 1.0 | 2.0 | 0.56 |

Tests were also conducted using the Micro-Ryder Gear test described by I. B. Goldman, in "Corrosive Wear as a Failure Mode in Lubricated Gear Contacts", Wear, 14 page 431 (1969), the disclosure of which is incorporated herein by reference. In this test, designed to assess the lube oil performance in gear operation, percent gear surface scuffed is measured as a function of applied load. The failure criterion is taken as the load at which 22% of the gear surface is scuffed. Using this test, both 1.0 wt.% diphenyl carbonate and 1.0 wt.% of ZDDP survived the highest applied loads.

Several tests were also run using a Vickers Vane Pump using a test method similar to the ASTM D2882 test at 33° C. This test is designed to measure the amount of wear on both the sliding vanes and the fixed ring of the Vickers Vane Pump. In thest test, the load upon the vanes was such as to produce unacceptably high levels of wear in the absence of additive. Tests were performed using a synthetic fluid having a viscosity of 2.4 mPa.s at 25° C. under wet air blanketing. The results of these tests are set forth in Table 3.

From Tables 2 and 3 it can be seen that the best overall results utilizing carbonates were achieved using ethylene carbonate and diphenyl carbonate as additives.

TABLE 3

| Additive in Synthetic Mineral Oil | Concentration (Wt. %) | Weight Loss (mg) | |
|---|---|---|---|
| | | Vanes | Ring |
| None | — | 44 | 752 |
| Di-o-tolyl Carbonate | 1.0 | 2 | 56 |
| Diphenyl Carbonate | 1.0 | 0 | 13 |
| Diethyl Carbonate | 1.0 | 7 | 560 |
| Ethylene (cyclic) Carbonate | 1.0 | 2 | 1 |
| Propylene (cylic) Carbonate | 1.0 | 5 | 12 |
| Di-n-hexyl Carbonate | 1.0 | 3 | 115 |
| Di-isobutyl Carbonate | 1.0 | 66 | 642 |
| Di-n-butyl Carbonate | 1.0 | 79 | 642 |
| Zinc Dialkyldithiophosphate | 1.0 | 1 | 5 |

Table 4 below presents additional data on the use of varying concentrations of ethylene carbonate and diphenyl carbonate in reducing wear and friction in base oil fluids. The lubricant fluid utilized comprised a synthetic fluid having a viscosity of 2.4 mPa.s at 25° C. to which had been added different concentrations of these esters studied. The tests were performed using the Ball-on-Cyclinder machine operated under dry air blanketing, by applying a 500 g load for 32 minutes at 25° C. while the cylinder is rotated at 240 rpm. The metallurgy used was 52100 steel for both the ball and the cylinder. The machine, described in detail in the previously referenced Benzing, et al., publication at page 280, comprises a stationary ball sliding over a rotating cylinder which dips into the test oil and brings the oil into the conjunction between the ball and the cylinder as the cylinder rotates.

TABLE 4

| Additive | Concentration (Wt. %) | Wear Scar Diameter (mm) | Coefficient of Friction |
|---|---|---|---|
| None | — | 0.60 | 0.19 |
| Ethylene Carbonate | 0.3 | 0.23 | 0.14 |
| Ethylene Carbonate | 0.03 | 0.67 | 0.19 |
| Ethylene Carbonate | 0.003 | 0.67 | 0.18 |
| Diphenyl Carbonate | 1.0 | 0.44 | 0.15 |
| Diphenyl Carbonate | 0.1 | 0.60 | 0.16 |
| Diphenyl Carbonate | 0.01 | 0.52 | 0.18 |

However, cyclic carbonates, such as ethylene carbonate, have relatively low solubility in lube oil and therefore are not preferred. In a basestock the solubility of ethylene carbonate is about 0.04 wt.% at 25° C., while in a fully formulated motor oil the solubility of 25° C. is about 0.2 wt.%. However, exposure of the motor oil to low temperatures would reduce the solubility of the ethylene carbonate and may cause the ethylene carbonate to precipitate from the motor oil.

While the use of carbonates, such as diphenyl carbonate, generally reduce the wear and friction of lube oil to levels achieved by metal dialkyldithiophosphates, as shown in the following Comparative Examples and Examples, the combination of these compounds produce a lube oil having superior anti-wear and/or friction reducing properties, while having a reduced phosphorus content as compared to the use of only the metal dialkyldithiophosphate alone. In these Comparative Examples and Examples wear and the Coefficient of Friction were measured using the Ball-on-Cylinder (BOC) test described in the previously referenced Benzing, et al., publication at page 280, the disclosure of which is incorporated herein by reference. In these tests, oil maintained at a sump temperature of about 60° C. was run in a modified Ball-on-Cylinder test with the cylinder speed maintained at 0.25 rpm. The testing was carried out under conditions to accelerate wear. After the expiration of the test period, the resulting wear track on the cylinder was analyzed using a diamond tipped profilometer. Relative cylinder wear was established by comparing the cylinder wear volume for the test oil with that obtained using a reference fluid. The Coefficient of Friction was measured continuously by means of a linear variable differential transformer which translated a spring deflection due to the ball motion into an electrical signal which was plotted on paper.

COMPARATIVE EXAMPLES

Comparative Example I

A commercial mineral based lube oil having viscosity index improver, antioxidant, dispersant, detergent and antifoamant additives, but not having an anti-wear additive, as such, was utilized in a Ball-on-Cylinder test. The Coefficient of Friction was measured to be 0.28.

Comparative Example II

The lube oil of Comparative Example I was utilized having added thereto only 0.75 wt.% zinc dialkyldithiophosphate (ZDDP). The Coefficient of Friction was reduced to 0.23 and the wear relative to Comparative Example I was only 0.22.

Comparative Example III

The lube oil of Comparative Example I was utilized having added thereto only 1.5 wt.% zinc dialkyldithiophosphate. The Coefficient of Friction was reduced to 0.18 in the Ball-on-Cylinder test, while the relative wear was only 0.16 of the wear noted in Comparative Example I.

Comparative Example IV

The lube oil of Comparative Example I again was utilized with 1.0 wt.% diphenyl carbonate (DPC) added thereto. The Coefficient of Friction was measured to be 0.23 and the wear relative to Comparative Example I was 0.29.

Comparative Example V

The lube oil of Comparative Example I again was utilized with 1.5 wt.% diphenyl carbonate added thereto. The Coefficient of Friction was measured to be 0.23 and the wear relative to Comparative Example I was 0.50.

EXAMPLE

Example I

The lube oil of Comparative Example I was used with only 0.75 wt.% ZDDP and 0.75 wt.% diphenylcarbonate. The Coefficient of Friction was reduced to 0.15 and the wear relative to Comparative Example I was only 0.08.

Example II

The lube oil of Comparative Example I again was utilized with the addition thereto of only 1.0 wt.% ZDDP and 0.75 wt.% of diphenyl carbonate. The Coefficient of Friction was reduced to 0.18 and the wear relative to Comparative Example I was only 0.06.

The results of Comparative Examples I–V and Examples I–II are presented in Table 5.

TABLE 5

| Test Reference | Test Additives (Wt. %) | Total Wt. % of Additives | Coefficient of Friction | Cylinder Relative Wear |
|---|---|---|---|---|
| Comp. e.g. I | — | — | 0.28 | 1.0 |
| Comp. e.g. II | 0.75 wt. % ZDDP | 0.75 | 0.23 | 0.22 |
| Comp. e.g. III | 1.5 wt. % ZDDP | 1.5 | 0.18 | 0.16 |
| Comp. e.g. IV | 1.0 wt. % DPC | 1.0 | 0.23 | 0.29 |
| Comp. e.g. V | 1.5 wt. % DPC | 1.5 | 0.23 | 0.50 |
| Example I | 0.75 wt. % ZDDP<br>0.75 wt. % DPC | 1.5 | 0.15 | 0.08 |
| Example II | 1.0 wt. % ZDDP<br>0.75 wt. % DPC | 1.75 | 0.18 | 0.06 |

Based on the above, partially Comparative Examples III and V, and Example I all of which utilize 1.5 total wt.% of test additive, it can be seen that the addition of diphenyl carbonate to a lube oil reduces the quantity of metal dialkyldithiophosphate which is required for effective anti-wear and reduced Coefficient of Friction properties to levels comparable to that achieved using ZDDP alone at higher levels.

The quantity of diphenyl carbonate which is required will vary depending upon the desired degree of wear reduction, coefficient of friction desired, amount of metal dialkyldithiophosphate present and the specific operating parameters.

Typically, the weight ratio of the diphenyl carbonate to metal dialkyldithiophosphate will range from about 0.3:1 to about 10:1, preferably about 0.5:1 to about 1.5:1.

What is claimed is:

1. A lube oil having improved anti-wear properties comprising:

A. a lubricating oil;

B. about 0.1 to about 1.5 wt.% diphenyl carbonate; and

C. about 0.5 to about 2.0 wt.% of a zinc dialkyldithiophosphate.

2. The lube oil of claim 1 wherein the concentration of diphenyl carbonate ranges between about 0.5 and about 1.2 wt.% based upon the lubricating oil.

3. The lube oil of claim 2 wherein the weight ratio of diphenyl carbonate to zinc dialkyldithiophosphate ranges from about 0.3:1 to about 3:1.

4. The lube oil of claim 2 wherein the weight ratio of diphenyl carbonate to zinc dialkyldithiophosphate ranges from about 0.5:1 to about 1.5:1.

* * * * *